United States Patent [19]

Du Bois

[11] 3,999,295

[45] Dec. 28, 1976

[54] HAIR CUTTING APPARATUS

[75] Inventor: Jean P. Du Bois, Villa Park, Ill.

[73] Assignee: Sunbeam Corporation, Chicago, Ill.

[22] Filed: Apr. 19, 1976

[21] Appl. No.: 678,188

[52] U.S. Cl. ..... 30/195; 30/223

[51] Int. Cl.[2] ..... B26B 19/22

[58] Field of Search ..... 30/195, 196, 197, 208, 30/209, 210, 215, 216, 223, 224, 225, 220

[56] References Cited

UNITED STATES PATENTS

| | | | |
|---|---|---|---|
| 1,908,385 | 5/1933 | Wahl | 30/195 |
| 2,008,631 | 7/1935 | Udkovich | 30/195 |
| 2,118,850 | 5/1938 | Marcel | 30/197 |
| 3,571,928 | 3/1971 | Willey | 30/195 |

*Primary Examiner*—Al Lawrence Smith
*Assistant Examiner*—J. C. Peters
*Attorney, Agent, or Firm*—George R. Clark; Neil M. Rose

[57] ABSTRACT

In a hair cutting and grooming apparatus, a blade set having comb teeth which overlap the cutter teeth to a very limited extent in order to minimize the amount of hair engageable with and adapted to be cut by the reciprocating action of the cutting teeth. Guide means provided between the comb and cutter of the blade set accurately limit the overlap of tips of the cutter with the gullets of the comb teeth to a dimension of on the order of 0.005 to 0.020 inches.

10 Claims, 6 Drawing Figures

HAIR CUTTING APPARATUS

BACKGROUND OF THE INVENTION

In the hair cutting art it has been well known to provide hair clippers with means for adjusting or controlling the height of cut or the length of hair remaining after cutting with a hair clipper. In these prior art devices the comb or stationary blade is conventionally adjustable with respect to the cutter or movable blade so that the tips of the teeth on the cutter engage the comb teeth at a different location depending on whether it is desired to cut the hair short or long. Examples of such adjustment means are included in the U.S. Pat. Nos. to Wahl, 1,895,133; Andis, 2,869,234; and Bender et al, 3,531,862.

The comb teeth are designed to taper so that the teeth are thickest at the base and tapered to a point. When the cutter is adjusted so that the tips of the cutter teeth are in substantial alignment with the tips of the comb teeth, the shortest possible cut is obtained. As the cutter is retracted and the tips of the cutter teeth are moved toward the base of the comb teeth, the length of the hair remaining after the cutting is progressively longer.

It has also been known in the prior art to provide supplementary guards or attachments which are similarly used to control the length to which the hair is cut. Examples of such prior art are Waldron U.S. Pat. No. 2,229,688, and Malone, U.S. Pat. No. 2,716,809.

A somewhat different type of guard which limits the amount of engagement between the blade set and the hair is shown in Groves U.S. Pat. Nos. 2,867,902 and 3,651,570. The '570 Groves patent includes a frame 16 which is adjustably mounted on a hair clipper in a manner so that the teeth of the blade set are exposed through an opening 20 in the guard. Suitable adjustment of this guard can prevent an undesirable penetration of the clipper teeth into the hair when the hair is being cut by an amateur or by one using the hair clipper on himself. This type of undesirable penetration by a hair clipper is often referred to as gouging.

It has also been known in the prior art to utilize razor blades in connection with combs for the purpose of thinning hair. In some of these devices the blades have been made adjustable to control the operation of the blade in thinning the hair. Examples of these razor blade type hair thinning devices are shown in Grachan U.S. Pat. No. 2,252,628 and Szabo U.S. Pat. No. 3,183,589.

Another somewhat unusual type of clipper having adjustment means to regulate the amount of hair cut is shown in Carter U.S. Pat. No. 2,470,287. The Carter patent provides adjustment of the comb so that the cutter effectively engages either one of two sets of teeth. In the advanced position of the comb, the cutter teeth will overlap the deeper comb gullets while not overlapping the shallower comb gullets. This arrangement will vary considerably the amount of hair cut by the blade set.

All of the devices exemplified by the prior art patents illustrate means for varying the action of a hair clipper blade set in cutting hair. With the exception perhaps of the Groves patent, however, none of these devices provides an electric hair clipper which would be suitable for one's use in thinning, cutting, or grooming one's own hair. The principal difficulties involved in cutting one's own hair is the fact that one cannot properly observe the hair being cut and the fact that the hands and arms are so contorted to apply the hair clipper to the top, back, or sides of the head that all dexterity is virtually lost and gouging of the hair results.

With our present day hairstyles for men, it is well accepted to have considerably longer hair than was considered proper only a few years ago. It is no longer considered necessary for a man to visit his barbar once a week or once every two weeks to have his hair carefully edged and trimmed to give it a uniform appearance with the length increasing gradually from the very short hair on the neckline up the back and sides to the longer hair on the top. This so-called shingled or tapered effect which used to be required in a well-groomed head of hair is no longer considered necessary. Accordingly, the requirements for a hair clipper which would be usable to cut one's own hair has changed considerably. It would be desirable, however, to have a hair clipper which would effectively trim and thin hair between hair cuts to permit a man to still look neat even though he only has his hair cut once every few months.

BRIEF DESCRIPTION OF THE INVENTION

The present invention involves a hair clipper blade set which has the tips of the cutter teeth in a hair clipper blade set retracted so that there is a very slight overlap with respect to the gullets of the comb teeth. This arrangement limits the amount of hair which can be cut in any one pass through the hair and prevents one from accidentally penetrating the hair and creating unsightly gouges in the exposed hair. Repeated passes are required to accomplish any substantial removal of hair, but at the same time the danger of unsightly cuts in the hair is eliminated.

To accomplish the desired objective, the overlap between the cutter teeth and the comb teeth must be carefully controlled in order that there may be a very small and precise overlap. It has been found that with the tips of the cutter teeth overlapping the base of the comb teeth, an amount equal to between 0.005 and 0.020 inches, the objectives of the invention may be achieved. With this small amount of overlap, regardless of the amount of hair engaged between the adjacent teeth of the comb, the only hair that will be cut as the cutter reciprocates is a very small bunch of hair trapped at the end of the comb gullets and cut by the cutter as it traverses this small area. Depending on the nature and character of the hair and how tightly it is packed into the comb gullets only a few strands or as many as several dozen may be cut. Because of the very small dimension of the overlap, it is important that the relative position of the cutter with respect to the comb be precisely controlled. If the cutter is withdrawn slightly there would be no cutting action whatsoever or if it were advanced slightly the cutting action would be too aggressive to accomplish the desired objective.

Once it is understood that the limited overlap between the cutter and the comb teeth eliminates the possibility of cutting substantial amounts of hair, it may then be appreciated that the device may be used on oneself without any risk of gouging or creating unsightly cuts in one's hair. No matter how deeply the blade set is plunged into the hair, the amount of hair cut on each traversal by the cutter consists of a very limited amount. As a consequence of this severe limitation placed on the amount of hair cut, the device is of limited effectiveness insofar as normal hair clipping is concerned and would not be useful for giving a conventional haircut. However, it is useful and well adapted to thinning and grooming hair in a manner heretofore impossible. With present day hairstyles the subject invention serves as a grooming aid to maintain a hairstyle for a longer period of time. It is impossible to selectively trim a few hairs at a time to reduce the fullness and eliminate stray hairs which can make a hairstyle look unkempt.

Accordingly, it is an object of the present invention to provide an improved hair clipping device which is useful in thinning and grooming one's own hair.

It is a further object of the present invention to provide an improved barbering tool which may be readily used to groom one's own hair without risk of gouging or producing unsightly cuts in the hairstyle.

It is another object of the present invention to provide a hair clipping tool which includes a blade set having very limited overlap between the cutter and comb teeth so as to adapt it to grooming one's own hair.

Still another object of the present invention is to provide hair clipping apparatus in which the overlap between the comb teeth and the cutter teeth is limited to less than 0.020 inches to reduce the aggressiveness and hair cutting capacity of the unit.

Further objects and advantages of the present invention will become apparent as the following description proceeds and the features of novelty which characterize the invention will be pointed out with more particularity in the claims annexed to and forming a part of this specification.

DETAILED DESCRIPTION OF THE INVENTION

Figure 1:
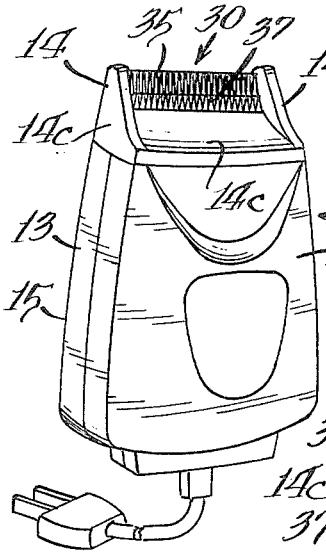
FIG. 1 is a perspective view of a hair cutting device embodying my invention.

Referring now to the drawings, there is shown in FIG. 1 a hair clipper or hair cutting device designated generally by reference numeral 11. The hair clipper 11 includes a front casing half 12, a rear casing half 13, and a head cap 14, which define a housing 15 within which a motor 17 is mounted.

The motor 17 is supported by the abutting casing halves 12 and 13 by rubber grommet members 18. The details of the motor construction and the manner in which it is supported in the housing are disclosed in detail in the U.S. Patent to Spohr, No. 3,218,708, and will be described only briefly herein. It should be understood, however, that the form of the housing and motor could be altered considerably since my invention involves the blade set and the means of supporting and driving it are only incidental to the actual invention.

The motor 17 is a vibratory type having a coil 20 which is supported on a laminated field 21. The field 21 is generally U-shaped providing an air gap within which an armature 22 is mounted for oscillation about an axis 23. Thus, when the coil 20 is energized with an alternating current, a changing magnetic field produced in the air gap causes the armature 22 to oscillate about its axis 23. The motor 17 includes springs 25 which serve to move the armature 22 to a rest position displaced with respect to the air gap in the intervals between the establishment of the magnetic field. The output of the motor 17 is delivered through a drive lever 26 which terminates in a spherical driving member 27.

Figure 2:
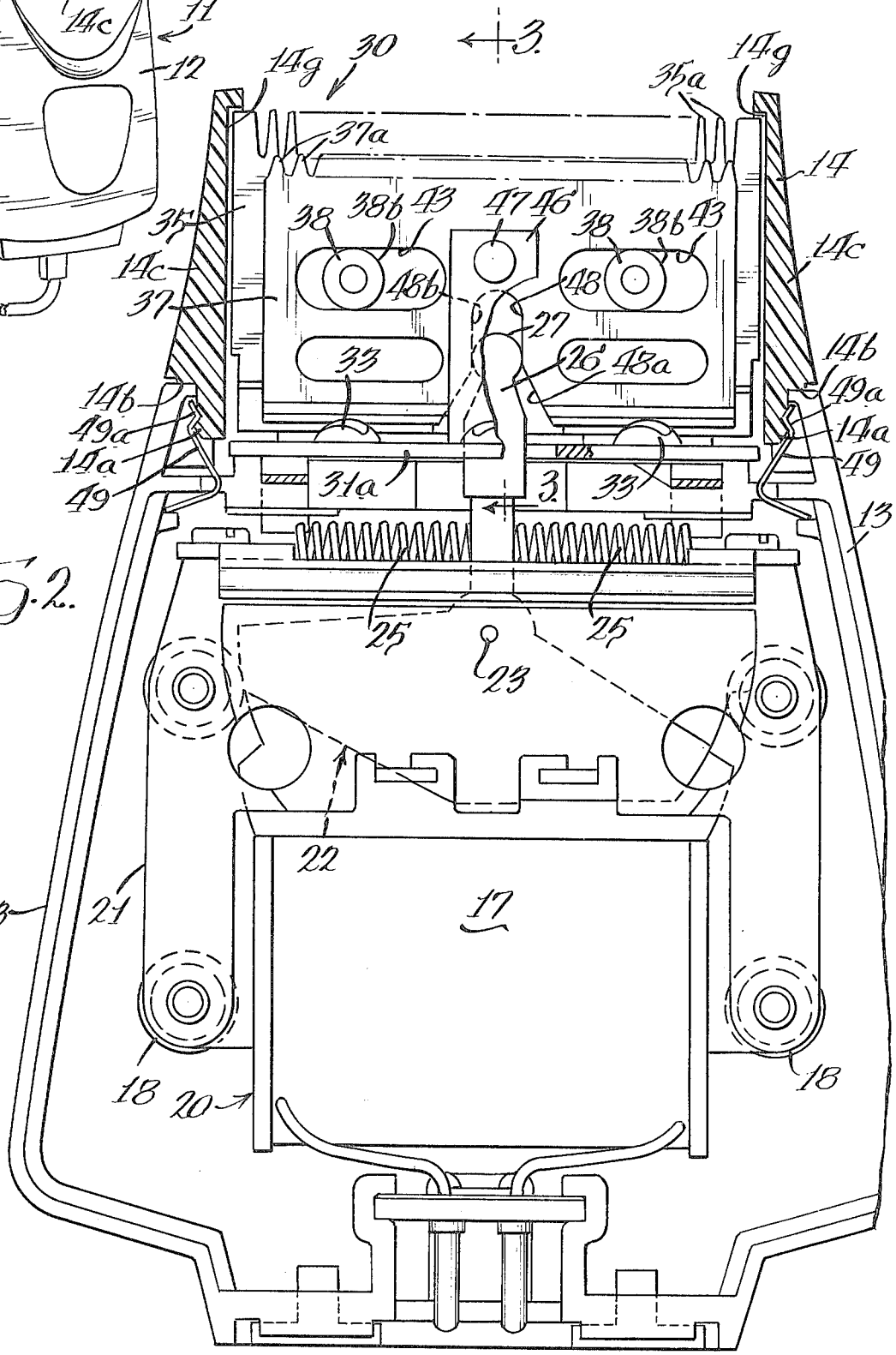
FIG. 2 is an enlarged sectional view of the hair cutting device of FIG. 1 shown with the front housing removed and the head cap shown in section to expose the blade set.
Figure 3:
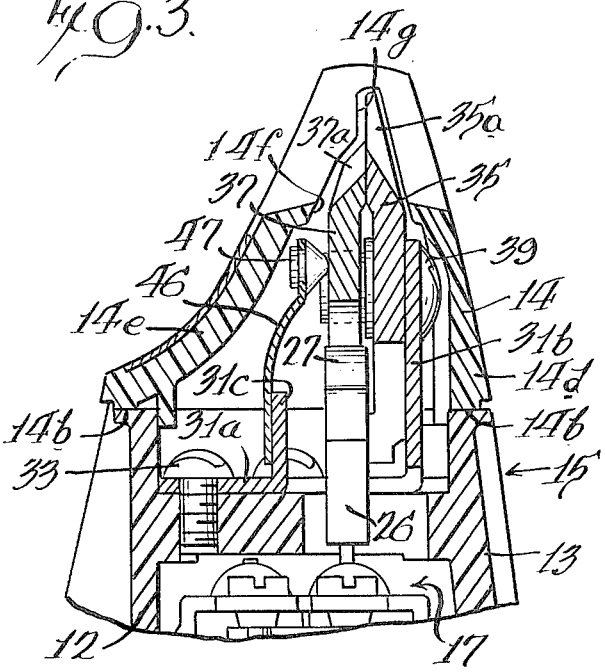
FIG. 3 is a sectional view taken substantially on Line 3—3 of FIG. 2 assuming FIG. 2 showed the complete device.
Figure 4:
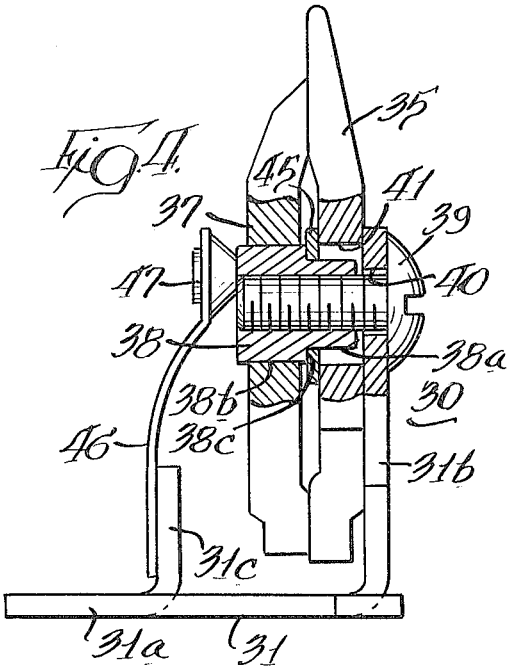
FIG. 4 is an end view of the blade set assembly of the device of FIGS. 1 to 3 with portions thereof shown in section.

In accordance with the present invention, the hair clipper 11 includes a blade set 30 which is best shown in FIGS. 2, 3, and 4. The blade set 30 includes a mounting frame 31 which is somewhat L-shaped in configuration having a base plate **31*a* which is secured to the front casing half 12 by means of screws 33 as shown in FIG. 3**.

The frame 31 also includes an upright portion **31*b* to which is secured a comb 35 and a movable cutter 37. In order to secure the comb 35 and the cutter 37 to the frame 31, there is provided a pair of threaded shoulder bushings 38 which are each threadedly engaged by a bolt 39 as shown in FIG. 4. Each bolt 39 extends through a hole 40 in the upright portion 31*b* of the frame 31. Corresponding to the holes 40 in the frame 31 are enlarged holes 41 in the comb 35. The bushings 38 are each formed with a reduced diameter portion 38*a* which extends into one of the openings 41 allowing substantial clearance so that the position of the comb 35 may be adjusted during assembly with respect to the frame 31**.

Each bushing 38 is also formed with an enlarged diameter portion **38*b* which is received within one of a pair of elongated openings or slots 43 formed in the cutter 37. The enlarged diameter portion 38*b* of each of the bushings 38 engages the parallel sidewalls of one of the elongated openings 43 and thereby guides the cutter 37 for rectilinear reciprocating movement with respect to the comb 35. Between the portions 38*a* and 38*b* of each bushing 38 there is a shoulder 38*c* which serves as an abuttment for a washer 45 received on the reduced diameter portion 38*a*. By tightening both of the bolts 39 into their respective bushings 38, the comb 35 is clamped against the upright portion 31*b* of the frame 31**.

As was mentioned above, the cutter 37 is provided with slots or elongated openings 43 which received the bushings 38 for guiding the cutter 37 with respect to the comb 35. In order to bias the cutter 37 into the shearing engagement with the comb 35, a spring 46 is mounted on an upwardly projecting tab **31*c* on the frame 31 with its free end supporting a nylon button 47 which is in sliding engagement with cutter 37. The button 47 extends through an opening in the spring 46 and may be secured thereto by either molding or by deforming the portion thereof remote from the cutter in a manner well known in the art. The spring 46 is formed so that in the position shown in FIGS. 3 and 4 it is applying a controlled pressure biasing the cutter 37 into engagement with the comb 35**.

Figure 5:
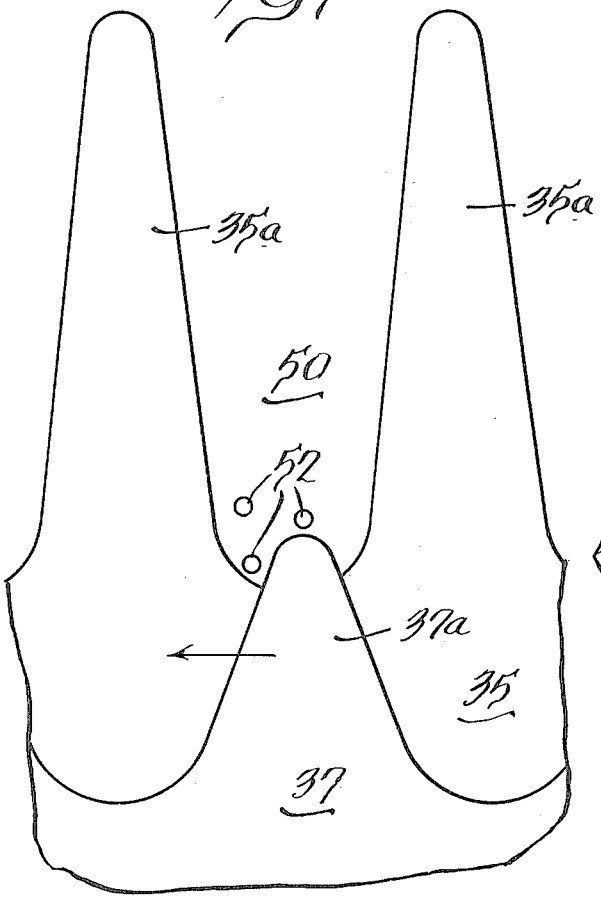
FIG. 5 is an enlarged fragmentary view of the comb and cutter teeth including a few hairs to demonstrate the cutting action of the device.
Figure 6:
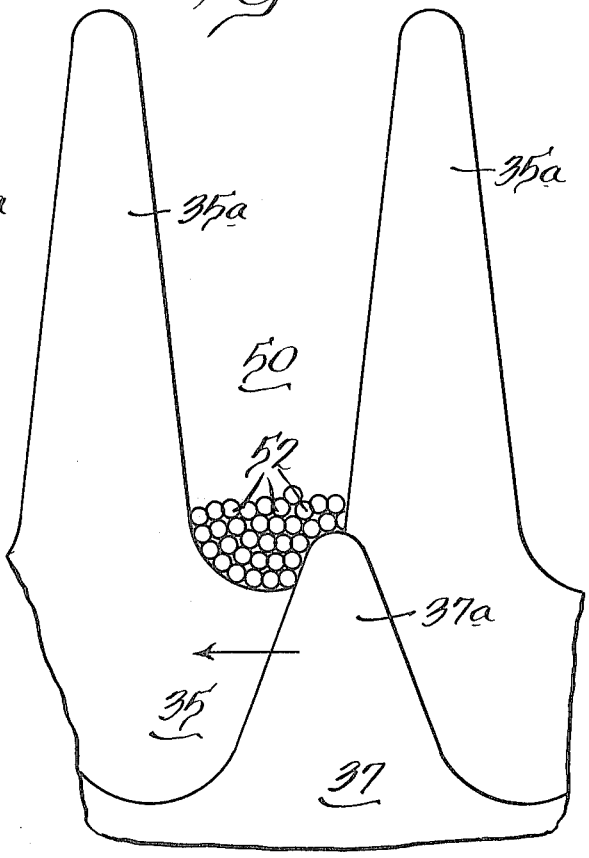
FIG. 6 is a view similar to FIG. 5 but illustrating an example in which the maximum amount of hair has packed into the comb gullets.

The comb 35 and the cutter 37 are of generally conventional configuration as compared to a conventional hair clipper blade set. The comb 35 is formed with elongated teeth 35*a* along one edge in a straight line forming a row of teeth. Each adjacent pair of teeth defines an elongated space or gullet 50 within which hair to be cut is received. The teeth 35*a* are rounded at their outer ends and tapered in a conventional manner. The cutter 37 is relatively conventional except that the teeth need not be as long as conventional hair clipper teeth. As is shown in FIGS. 5 and 6, the cutter 37 is formed with teeth 37*a*, the ends of which lie in a rectilinear line extending parallel to the direction in which the cutter 37 reciprocates. In order to accomplish the objectives of the invention, the cutter 37 must be positioned accurately and guided precisely so that the outer ends of the teeth 37*a* overlap the inner ends of the gullets 50 to a very limited extent. It has been found that this overlap should be on the order of 0.005 to 0.020 inches to accomplish the objectives of the invention. If any less overlap is provided, very little hair cutting is achieved and if any substantial additional overlap is provided, the amount of hair clipping is too great and the advantage of avoidance of gouging may not be obtained.

In order to obtain the very small overlap of the cutter teeth with respect to the comb teeth to achieve the objectives of the invention, it is necessary to include means to adjust the relationship between the comb 35 and the cutter 37. It would be impractical to attempt fabrication of the parts to tolerances so that a predetermined overlap could be automatically obtained with a tolerance of on the order of plus or minus 0.001 inch. To simplify this fabrication problem the holes 41 in the comb 35 are made oversized as compared to the diameter of the bushings 38 which extend therethrough. This relationship is well illustrated by FIG. 4. In the manufacturing operation and specifically in the assembly of the comb 35, the cutter 37, and the bushings 38 to the frame 31, assembly jigs are utilized to position the comb teeth 35*a* with the predetermined overlap with respect to the cutter teeth 37*a* prior to the tightening down of the bolts 39 which then establish the relationship between the comb 35 and the cutter 37.

The motor 17 was described above as having a drive lever 26 provided with a spherical driving member 27. The cutter 37, as best shown in FIG. 2, is formed with an open slot 48 into which the spherical member 27 of the drive lever 26 extends when the blade set 30 is assembled to the housing 15 of the hair cutting device 11. In order that the blade set 30 may be easily assembled to the hair cutting device 11 without careful positioning of the cutter 37, the slot 48 is formed with divergent walls 48*a* which guide the drive lever 26 into engagement with the inner portion of the slot 48 having spaced parallel walls 48*b*. The walls 48*b* snugly receive the spherical driving member 27 so that the motor may reciprocate the cutter 37 with a minimum amount of noise and vibration from the engagement within the slot 48.

The head cap 14 which cooperates with the casing halves 12 and 13 to form the housing enclosure for the motor is retained, with respect to the casing halves, by a pair of springs 49 which, as shown in FIG. 2, are generally L-shaped in configuration. The uppermost ends of the springs 49 are formed with V-shaped bends to provide detent portions 49*a* which engage complimentary ridges 14*a* on the head cap 14. The springs 49 are mounted and secured in the casing halves 12 and 13 by integrally formed walls but leaving the detent portions 49*a* thereof free to deflect as the head cap 14 with its associated ribs 14*a* is moved into engagement with the detent portions 49*a*.

With the head frame 14 engaged with the retaining detent portions 49*a*, the head cap has a peripheral shoulder portion 14*b* which engages the upper edges of the casing halves 12 and 13 providing a smooth transition in the walls forming the housing 15. The head cap 14 includes sidewalls 14*c*, a rear wall 14*d*, and a sloping front wall 14*e*. The upper edges of the rear wall 14*d* and front wall 14*e* are spaced to define an opening 14*f* through which the teeth on the blade set 30 extend as is best shown in FIGS. 1 and 3. As shown in FIG. 2, the end walls 14*c* are provided with recesses 14*g* to receive the ends of the comb 35. Thus, the head cap 14 encloses the drive mechanism including the drive lever 26 and spring 46 and also encloses the portions of the comb 35 and cutter 37 which are inoperative insofar as cutting hair is concerned, leaving only the comb teeth 35*a* and the cutter teeth 37*a* exposed. The front wall 14*e* of the head cap 14 is angled back sharply so as to minimize any visual obstruction to the operative and exposed portions of the blade set 30. Similarly, the rear wall 14*d* is angled slightly and is closely spaced to the blade set to minimize any obstruction that it might otherwise provide.

When it is necessary to gain access to the blade set 30 either to remove it from the hair clipping device 11 or to clean and lubricate the comb 35 and the cutter 37, the head cap 14 may be easily removed by simply applying pressure to disengage it from the casing halves 12 and 13. When such pressure is applied, the detent portions 49*a* of the springs 49 will deflect, allowing the head cap 14 to be removed. After the blade set has been replaced, serviced, or cleaned, it is then a simple matter to replace the head cap 4 on the housing with the ribs 14*a* of the head cap engaged with the detent portions 49*a*.

To better appreciate the manner in which the blade set 30 operates in thinning or grooming the hair, reference should be had to FIGS. 5 and 6. In each of these figures a number of pieces of hair 52 have been shown. In the example of FIG. 5 there are only a few pieces of hair as in the case of someone trying to trim a few stray hairs on his head. It is noted that only the hairs that move to the base of the comb gullets 50 are in a position to be trimmed by the teeth 37*a* as they reciprocate. Similarly, when the hair clipper 11 is applied to the hair with the blade set 30 inserted deeply into the hair, the pieces of hair 52 may be described as packed into the base or end of the gullets 50. Even in such a situation, however, the number of hair strands which are engageable by the cutter teeth 37*a* to be sheared is fairly limited. Accordingly, no matter how the hair clipper is forced into the hair, the cut made by the blade set 30 will be small enough that no discernible gouging or damage to the hairstyle will be caused.

In using the hair cutting device 11, it is held in the palm of the hand with the housing 15 extending generally in the same direction as the fingers with the head cap 14 protruding outwardly from the fingers. The device 11 may then be applied to the hair to trim and groom the hair. The blade set 30 is completely enclosed by the housing 15, except for the cutting teeth on the comb 35 and cutter 37 as is evident from FIG. 3. In a conventional hair clipper the housing is arranged so that the comb plate is relatively exposed throughout its length and width permitting it to be moved along the head or scalp substantially parallel and, either in engagement with, or closely spaced from the portion of the scalp from which the hair being cut extends. This arrangement permits, among other things, for the hair to be cut close to the scalp. In connection with the device 11, however, it is not used for conventional hair cutting but rather for the trimming of stray hairs or lessening the fullness of thick hair.

In order to operate effectively, the blade set 30 must be engaged against the head or hair so that the hair will move in completely to the end of the comb gullets as shown in FIG. 6. This requires that the angle of the hair clipping device 11 be positioned with respect to the hair such that the teeth 35 are extending substantially perpendicular or normal to the head. Since the hair being cut is, generally speaking, long hair which lies parallel to the surface of the head, rather than upstanding as in connection with short hair, it is desirable that the device 11 along with the blade set be oriented quite differently with respect to the hair being cut than is true with a conventional hair clipper. In this connection it should also be noted that the blade set 30 is arranged so that the plane of the blade set is generally in the same plane as the generally flat housing 15. In most hair clippers which are designed to be used with the comb flat with respect to the side of the head or scalp, the blade set is conventionally angled with respect to the lengthwise axis of the housing of the clipper. The radically different type of blade set and the different type of clipping involved with the present invention makes it advantageous to orient the blade set so that it is essentially in the same plane as the axis of the housing. This arrangement facilitates engaging the blade set with the hair to cut and groom the hair in the most effective manner.

While there has been shown and described a specific embodiment of the present invention, it will be apparent to those skilled in the art that various changes and modifications may be made without departing from the invention in its broader aspects, and it is, therefore, contemplated in the appended claims to cover all such changes and modifications as fall within the true spirit and scope of the present invention.

What is claimed as new and desired to be secured by Letters Patent of the United States is:

1. In a hair clipping and grooming device, a blade set comprising a comb, a cutter mounted for reciprocating rectilinear movement in engagement with said comb, a row of hair cutting teeth formed on one edge of said comb each adjacent pair of teeth in said row defining a gullet, each said gullet terminating at the base of the teeth which define it and said gullet terminations lying along a line extending parallel to the direction of said cutter movement, said cutter being formed with teeth along one edge thereof, the tips of said cutter teeth lying along a straight line parallel to the direction of said cutter movement, said tips of said cutter teeth overlapping said gullets a distance equal to the diameter of several hairs whereby hair cutting occurs only at the base of the comb teeth and only a small fraction of the hairs between the comb teeth are subject to being cut.

2. The combination of claim 1 wherein the means mounting said cutter with respect to said comb includes guide posts on said comb, elongated slots in said cutter receiving said posts and guiding said cutter for reciprocating movement, said posts comprising threaded bushings, a support frame having holes aligned with holes in said comb, bolts extending through said aligned holes into threaded engagement with said bushings clamping said comb to said frame.

3. The combination of claim 2 wherein said comb is formed with holes through which said bushings extend, shoulder means on said bushings in engagement with said comb to clamp said comb to said frame, said holes in said comb being greater in diameter than said bushing to permit said posts to be adjustably positioned with respect to said comb to modify the overlap of said cutter teeth with respect to said gullets.

4. The combination of claim 1 wherein said cutter teeth overlap said comb gullets a distance of between 0.005 and 0.020 inches.

5. In a hair clipping and grooming device, a blade set comprising a comb, means for fixedly mounting said comb with respect to a hair clipper, a cutter mounted for reciprocating rectilinear movement in engagement with said comb, a row of hair cutting teeth formed on one edge of said comb with each adjacent pair of teeth in said row defining a gullet, each said gullet terminating at the base of the teeth which define it and said gullet terminations lie along a line extending parallel to the direction of said cutter movement, said cutter being formed with teeth along one edge thereof, the tips of said cutter teeth lying along a line parallel to the direction of said cutter movement, said tips of said cutter teeth overlapping said gullets a distance of between 0.005 and 0.020 inches.

6. In a hair clipping and grooming device, a blade set comprising a comb, means for fixedly mounting said comb with respect to a hair clipper, a cutter mounted for reciprocating rectilinear movement in engagement with said comb, a row of hair cutting teeth formed on one edge of said comb with each adjacent pair of teeth in said row defining a gullet, each said gullet terminating at the base of the teeth which define it and said gullet terminations lie along a line extending parallel to the direction of said cutter movement, said cutter being formed with teeth along one edge thereof, the tips of said cutter teeth lying along a straight line parallel to the direction of said cutter movement, said tips of said cutter teeth overlapping only the inner closed end of said gullets, said comb teeth extending far beyond said cutter teeth and serving to gather hair and guide it into the inner closed ends thereof permitting the overlapping tips of said cutter to cut only small amounts of hair upon reciprocation of said cutter.

7. The blade set of claim 6 wherein the tips of the comb teeth and the cutter teeth are rounded and said cutter teeth overlap said comb gullets a distance of between 0.005 and 0.020 inches.

8. A hair grooming device having a housing enclosing a motor and partially enclosing a blade set, an elongated opening at one end of said housing through which said blade set extends, said blade set including a comb fixedly mounted with respect to said housing, a cutter mounted for reciprocation in shearing engagement with said comb, said comb and said cutter each having a row of teeth formed on respective edges thereof each row extending in a straight line, the tips of said cutter teeth overlapping only the base of said comb teeth, only the toothed portions of said comb and cutter protruding outside of said housing, said housing overlying said blade set immediately adjacent to said teeth thereby obstructing entry of hair into the spaces between said teeth whereby said teeth are engaged with said hair generally normal to said hair.

9. A hair grooming device having a housing enclosing a motor and supporting a blade set connected to be driven by said motor, said blade set including a comb fixedly mounted with respect to said housing and a cutter mounted for reciprocating in shearing engagement with said comb, said comb and said cutter each having a row of teeth formed on respective edges thereof each row extending in a straight line, means restricting the quantity of hair engageable by said cutter, by limiting the length of the cutter teeth engageable with said comb teeth to less than 0.020 inches in the direction normal to the rows of teeth, the outer ends of said comb teeth extending beyond the outer ends of said cutter teeth whereby a quantity of hair may be engaged between adjacent comb teeth and only a small portion thereof cut by said cutter teeth to limit the effectiveness of said grooming device for clipping hair.

10. The combination of claim 9 wherein said length of the cutter teeth engageable with said comb teeth is at least 0.005 inches.

* * * * *